US008318006B2

(12) United States Patent
Benazzi et al.

(10) Patent No.: US 8,318,006 B2
(45) Date of Patent: Nov. 27, 2012

(54) "ONCE THROUGH" PROCESS FOR HYDROCRACKING HYDROCARBON-CONTAINING FEEDS WITH HIGH NITROGEN CONTENTS

(75) Inventors: Eric Benazzi, Chatou (FR); Pierre Marion, Antony (FR); Christophe Gueret, St. Romain en Gal (FR)

(73) Assignee: IFP Energies Nouvelles, Rueil Malmaison Cedex (FR)

( * ) Notice: Subject to any disclaimer, the term of this patent is extended or adjusted under 35 U.S.C. 154(b) by 1833 days.

(21) Appl. No.: 10/270,075

(22) Filed: Oct. 15, 2002

(65) Prior Publication Data

US 2003/0085154 A1 May 8, 2003

(30) Foreign Application Priority Data

Oct. 15, 2001 (FR) ..... 01 13300

(51) Int. Cl.
*C10G 45/04* (2006.01)
*C10G 47/02* (2006.01)

(52) U.S. Cl. ..... 208/212; 208/111.35; 208/111.3; 208/111.05; 208/210; 208/108; 208/254 H

(58) Field of Classification Search ..... 422/188; 208/89, 111.01, 111.05, 111.15
See application file for complete search history.

(56) References Cited

U.S. PATENT DOCUMENTS 3,256,178 A * 6/1966 Hass et al. ..... 208/89
3,364,133 A 1/1968 Duir et al.
3,409,538 A * 11/1968 Gleim et al. ..... 208/59
3,427,243 A * 2/1969 Hass et al. ..... 208/111.15
3,592,759 A * 7/1971 Pollitzer ..... 208/89
3,598,723 A * 8/1971 Rausch ..... 208/111.05
3,702,818 A * 11/1972 Streed et al. ..... 208/89
3,923,638 A 12/1975 Bertolacini et al.
4,058,449 A 11/1977 Reitz et al.
4,313,817 A 2/1982 Mayer et al.
4,368,113 A * 1/1983 Winter et al. ..... 208/89
4,392,945 A * 7/1983 Howard et al. ..... 208/210
4,469,590 A * 9/1984 Schucker et al. ..... 208/143
5,228,979 A * 7/1993 Ward ..... 208/111.15
5,525,209 A 6/1996 Billon et al.
5,624,547 A * 4/1997 Sudhakar et al. ..... 208/89
5,888,377 A * 3/1999 Bertram ..... 208/59
6,702,935 B2 * 3/2004 Cash et al. ..... 208/58
6,797,154 B2 * 9/2004 Mukherjee et al. ..... 208/58
7,128,828 B1 * 10/2006 Kalnes ..... 208/89
2012/0031811 A1 * 2/2012 Cowan et al. ..... 208/57

* cited by examiner

*Primary Examiner* — Tam M Nguyen
(74) *Attorney, Agent, or Firm* — Millen, White, Zelano & Branigan, P.C.

(57) ABSTRACT

The present invention concerns an improved once-through process for hydrocracking hydrocarbon-containing feeds with high nitrogen contents, with partial elimination of ammonia, for example by a hot flash located between the hydrorefining zone and the hydrocracking zone. Said hot flash drum functions at a pressure close to that of the hydrorefining reactor and at a temperature in the range from 150° C. to the hydrorefining reactor outlet temperature.

17 Claims, 1 Drawing Sheet

"ONCE THROUGH" PROCESS FOR HYDROCRACKING HYDROCARBON-CONTAINING FEEDS WITH HIGH NITROGEN CONTENTS

The present invention relates to an improved "once-through" process for hydrocracking hydrocarbon feeds, in particular feeds containing large amounts of nitrogen.

The process essentially aims to produce middle distillates, i.e., cuts with initial boiling points of at least 150° C. and end points up to just before the initial boiling point of the residue, for example less than 340° C. or 370° C. and optionally, base oils (residue).

PRIOR ART

Hydrocracking heavy petroleum cuts is a very important refining process that produces lighter fractions such as gasoline, jet fuel and light gas oils which the refiner desires in order to adapt production to demand, from excess heavy feeds which are difficult to upgrade. Certain hydrocracking processes can also produce a highly purified residue that can provide excellent bases for oils. Compared with catalytic cracking, the advantage of catalytic hydrocracking is the production of very good quality middle distillates, jet fuels and gas oils. However, the octane number of the gasoline produced is much lower than that produced by catalytic cracking.

Hydrocracking is a process which draws its flexibility from three principal elements, namely the operating conditions used, the types of catalysts employed and the fact that hydrocracking hydrocarbon-containing feeds can be carried out in one or two steps.

Hydrocracking is a process that can be classified into different versions, the principal versions of which are:

Hydrocracking in a single step, which generally initially comprises intense hydrorefining to carry out hydrodenitrogenation and intense desulphurisation of the feed before it is sent over the hydrocracking catalyst per se, in particular when the latter comprises a zeolite. That intense hydrorefining of the feed only causes limited conversion of the feed into lighter fractions, which is insufficient and thus must be completed using the more active hydrocracking catalyst. However, it should be noted that no separation takes place between the two types of catalysts. The whole of the effluent leaving the reactor is injected onto the hydrocracking catalyst per se and separation of the products formed is only carried out subsequently. That hydrocracking version, known as "once through" hydrocracking, has a variation in which an unconverted fraction is recycled to the reactor for more intense conversion of the feed.

Two-step hydrocracking comprises a first step aimed, like the once-through process, at hydrorefining the feed but also at achieving a conversion of the latter of the order of 40% to 60% in general. The effluent from the first step then undergoes separation (distillation) usually termed intermediate separation, which separates the conversion products from the unconverted fraction. In the second step of a two-step hydrocracking process, only the fraction of the feed that is not converted during the first step is treated. This separation allows a two-step hydrocracking process to be more selective for middle distillates (kerosene+diesel) than a once-through process. Intermediate separation of the conversion products avoids "over-cracking" to naphtha and gas in the second step on the hydrocracking catalyst. Further, it should be noted that the unconverted fraction of the feed treated in the second step generally contains very small amounts of $NH_3$ and organic nitrogen-containing compounds, in general less than 20 ppm by weight or less than 10 ppm by weight.

The disadvantage of a two-step hydrocracking process is that it is intrinsically more expensive than a once-through hydrocracking process. The intermediate separation step, generally an atmospheric pressure distillation train, results in a drop in the operating pressure (high) to atmospheric pressure and necessitates recompression for the second step. That recompression means an increase in the amount of equipment (pump, heat exchangers, still).

Conventionally, the two-step process can be carried out either with intermediate separation after hydrorefining in a process comprising a hydrorefining reactor and a hydrocracking reactor, or with intermediate separation between the first and second hydrocracking reactor in a process comprising the hydrorefining reactors, first hydrocracking, and second hydrocracking in series. The two-step hydrocracking process thus provides an answer to hydrocracking feeds containing large amounts of organic nitrogen, as it can eliminate practically all of the ammonia produced during the first hydrorefining step in that intermediate separation step. According to the prior art, all two-step prior art processes operate in the absence (or near absence) of ammonia in the second hydrocracking reactor, essentially for two reasons. The first is that in the absence of ammonia, the second hydrocracking reactor can operate at a lower temperature than the first reactor (270-370° C. and 300-450° C. respectively). The second reason is that the absence of ammonia allows catalysts comprising noble metals or sulphur-containing metals to be used. An absence or near absence of ammonia has always been recommended and employed.

It has been shown that the once-through process has disadvantages when treating feeds with high organic nitrogen contents, i.e., comprising large amounts of organic compounds containing at least one nitrogen atom. The temperatures have to be raised and thus are no longer compatible with acceptable cycle times. In practice, in the case of a new design, the contact time is increased, which results in unacceptable reactor volumes. Further, the high temperatures required to obtain sufficiently high feed conversions also degrades the quality of the products (higher aromatics contents, for example).

Thus, a process has been sought that has a reasonable cost while maintaining the pressure, and thus is a once-through process that can treat feeds with high nitrogen contents and can treat said feeds with routine catalyst cycles to obtain good quality products with the same selectivity for middle distillates.

U.S. Pat. No. 3,816,296 shows that it is possible, when using a catalyst that may contain a zeolite, to increase the selectivity for middle distillates in the second step for hydrocracking a hydrocarbon-containing feed containing less than 10 ppm of organic nitrogen by adding to the latter a nitrogen content (deriving from ammonia or amines containing less than 15 carbon atoms) in the range 5 to 100 ppm by weight (with respect to the feed). The quantity of nitrogen added must then be strictly controlled and maintained between said limits. There is no disclosure of any effects on the operating conditions.

In contrast to the prior art, the research carried out by the Applicant has led to the discovery that, surprisingly, in a "once-through" hydrocracking process, it is possible to treat feeds with a high organic nitrogen content provided that between the first hydrorefining zone and the second zone comprising hydrocracking in a once-through series flow process, a hot flash is introduced functioning at a pressure close to that of the first reaction zone of the process, more particularly that of the last hydrorefining reactor (at the outlet) and at a temperature in the range 150° C. to the reactor outlet temperature. Preferably, the hot flash functions at a temperature in the range 170° C. to 280° C., more preferably in the range 190° C. to 250° C. Said hot flash can eliminate at least a portion of the ammonia produced in the hydrorefining reactor and good catalytic activity can be produced, so that a catalyst comprising a crystalline acid function such as a Y zeolite or an amorphous catalyst such as a silica-alumina can be used in the second reaction zone of the process.

This process can produce activities and selectivities for middle distillates that are improved over the prior art. Preferably, in accordance with the invention, the second reaction zone contains at least one bed of hydrorefining catalyst upstream of the hydrocracking catalyst. Advantageously, the beds of hydrorefining catalyst and hydrocracking catalyst are located in the same reactor.

By controlling the quantity of ammonia admitted to the hydrocracking catalyst present in the second reactor, this process can also considerably increase the flexibility of a once-through hydrocracking process regardless of the hydrocracking catalyst used (zeolitic or amorphous) and without the need to carry out a decompression between the first and second reaction zones. Depending on the degree of denitrogenation obtained in the second reaction zone and depending on the proportion of $NH_3$ separated, it may be advantageous to place a hydrorefining catalyst upstream of the hydrocracking catalyst in the second reaction zone to control the partial pressure of $NH_3$ reigning above the hydrocracking catalyst.

It should also be noted that introducing a hot flash between the catalytic hydrorefining beds or the two hydrorefining reactors does not increase the overall reaction volume dedicated to hydrorefining. Thus, the cost of the reactors remains substantially the same.

DETAILED DESCRIPTION OF THE INVENTION

More precisely, the invention describes a once-through process for hydrocracking hydrocarbon-containing feeds for the production of middle distillates and possibly base oils comprising at least one first reaction zone including a hydrorefining step, and at least one second reaction zone, in which hydrocracking of at least a portion of the effluent from the first reaction zone is carried out. The process of the invention also comprises incomplete separation of ammonia from the effluent leaving the first zone. Said separation is advantageously carried out using an intermediate hot flash. The hydrocracking carried out in the second reaction zone is carried out in the presence of ammonia in an amount that is lower than the quantity present in the feed, preferably less than 1500 ppm by weight, more preferably less than 1000 ppm and still more preferably less than 800 ppm by weight of nitrogen.

The quantity of ammonia present during the hydrocracking reaction is more than 100 ppm, preferably more than 110 ppm by weight of nitrogen, more preferably more than 200 ppm and still more preferably more than 300 ppm. When hydrocracking is carried out on a zeolite based catalyst, the organic nitrogen content in the effluent admitted onto the zeolitic catalyst is highly advantageously less than 20 ppm by weight, preferably less than 10 ppm by weight.

The presence of ammonia in these quantities allows substantial gains in the selectivity for middle distillates for the zeolitic catalyst. The improved selectivity is obtained with reasonable increases in the reaction temperatures while conserving the stability of the zeolite, i.e., the catalyst service life. It has also been discovered that the selectivity for gas oil (for example with cut points of 250-380° C.) is higher for higher quantities of ammonia (more than 150 ppm, or preferably more than 200 ppm by weight of nitrogen).

First Reaction Zone

A wide variety of feeds can be treated using the process of the invention; generally, they contain at least 20% by volume and usually at least 80% by volume of compounds boiling above 340° C.

The feed can, for example, be part of a LCO (light cycle oil), atmospheric distillate or vacuum distillate, for example gas oil from straight run distillation of crude oil or conversion units such as FCC, a coker or visbreaking, and feeds from units for extracting aromatics from lubricating oil bases or from solvent dewaxing of lubricating oil bases, or distillates from desulphurising or hydroconverting atmospheric residues (AR) and/or vacuum residues (VR), or the feed can be a deasphalted oil or any mixture of the feeds cited above. The above list is not limiting. Preferably, the boiling point T5 of the feeds is more than 340° C., preferably more than 370° C., i.e., 95% of the compounds present in the feed have a boiling point of more than 340° C., preferably more than 370° C.

The nitrogen content of the hydrocarbon-containing feeds treated in the process of the invention is normally more than 500 ppm, preferably in the range 500 to 5000 ppm by weight, more preferably in the range 700 to 4000 ppm by weight, still more preferably in the range 1000 to 4000 ppm. Generally, the sulphur content is in the range 0.01% to 5% by weight, more generally in the range 0.2% to 4%.

The feed undergoes at least one hydrorefining step (hydrodesulphurisation, hydrodenitrogenation, conversion) in the first reaction zone.

Conventional catalysts can be used, containing at least one amorphous support and at least one hydrodehydrogenating element (generally at least one element from group VIB and non noble group VIII, and usually at least one element from group VIB and at least one element from non noble group VIII).

Highly advantageously, in the hydrocracking process of the invention, the feed to be treated is brought into contact in the presence of hydrogen with a hydrorefining catalyst comprising at least one matrix, at least one hydrodehydrogenating element selected from the group formed by elements from group VIB and group VIII of the periodic table, optionally at least one promoter element deposited on the catalyst and selected from the group formed by phosphorus, boron and silicon, optionally at least one element from group VIIA (preferably chlorine or fluorine), optionally at least one element from group VIIB (preferably manganese), optionally at least one element from group VB (preferably niobium).

Preferably, the catalyst contains boron and/or silicon as a promoter element, optionally with phosphorous as a further promoter element. The amounts of boron, silicon and phosphorus are then 0.1-20%, preferably 0.1-15%, more advantageously 0.1-10%.

Non limiting examples of matrices that can be used alone or as a mixture are alumina, halogenated alumina, silica, silica-alumina, clays (selected, for example, from natural clays such as kaoline or bentonite), magnesia, titanium oxide, boron oxide, zirconia, aluminium phosphates, titanium phosphates, zirconium phosphates, charcoal and aluminates. Preferably, matrices containing alumina in any form that is known to the skilled person, more preferably aluminas, for example gamma alumina, are used.

The role of the hydrodehydrogenating function is preferably fulfilled by at least one metal or compound of a metal from non noble group VIII and group VI, preferably selected from molybdenum, tungsten, nickel and cobalt. Preferably, this role is fulfilled by a combination of at least one group VIII element (Ni, Co) with at least one group VIB element (Mo, W).

This catalyst can advantageously contain phosphorus; in fact, the prior art shows that this compound has two advantages over hydrorefining catalysts: ease of preparation in particular during impregnation with nickel and molybdenum solutions, and better hydrogenation activity.

In a preferred catalyst, the total concentration of oxides of metals from groups VI and VIII is in the range 5% to 40% by weight, preferably in the range 7% to 30%, and the weight ratio, expressed as the metal oxide, between the group VIB metal (or metals) and the group VIII metal (or metals) is preferably in the range 20 to 1.5, more preferably in the range 10 to 2. The concentration of phosphorous oxide $P_2O_5$ will be less than 15% by weight, preferably less than 10% by weight.

A further preferred catalyst that contains boron and/or silicon (preferably boron and silicon) generally comprises, as a % by weight with respect to the total catalyst mass, at least one metal selected from the following groups and in the following amounts:

3% to 60%, preferably 3% to 45%, more preferably 3% to 30% of at least one group VIB metal; and optionally 0 to 30%, preferably 0 to 25%, still more preferably 0 to 20%, of at least one group VIII metal;

the catalyst further comprising at least one support selected from the following groups in the following amounts:

0 to 99%, advantageously 0.1% to 99%, preferably 10% to 98%, and still more preferably 15% to 95%, of at least one amorphous or low crystallinity matrix;

said catalyst being characterized in that it also comprises:

0.1% to 20%, preferably 0.1% to 15%, more preferably 0.1% to 10% of boron and/or 0.1% to 20%, preferably 0.1% to 15%, more preferably 0.1% to 10% of silicon;

and optionally:

0 to 20%, preferably 0.1% to 15%, more preferably 0.1% to 10% of phosphorus;

and optionally again:

0 to 20%, preferably 0.1% to 15%, more preferably 0.1% to 10% of at least one element selected from group VIIA, preferably fluorine.

In general, formulae with the following atomic ratios are preferred:

a group VIII metal/group VIB metal atomic ratio in the range 0 to 1;

a B/group VIB metal atomic ratio in the range 0.01 to 3;

a Si/group VIB metal atomic ratio in the range 0.01 to 1.5;

a P/group VIB metal atomic ratio in the range 0.01 to 1;

a group VIIA element/group VIB metal atomic ratio in the range 0.01 to 2.

Such a catalyst has a higher activity for hydrogenating aromatic hydrocarbons and hydrodenitrogenation and hydrodesulphurisation than those for catalytic formulae with no boron and/or silicon, and also has an activity and selectivity in hydrocracking that is higher than the catalytic formulae known in the prior art. The catalyst containing boron and silicon is particularly advantageous. Without wishing to be bound by any particular theory, it appears that this particularly high activity of catalysts containing boron and silicon is due to a strengthening of the acidity of the catalyst by the joint presence of boron and silicon in the matrix, inducing an improvement in hydrogenating, hydrodesulphurization and hydrodenitrogenation properties and an improvement in the hydrocracking activity compared with catalysts normally used in hydroconverting hydrorefining reactions.

Preferred catalysts are NiMo and/or NiW on alumina, also NiMo and/or NiW on alumina doped with at least one element from the group of atoms formed by phosphorus, boron, silicon and fluorine, or NiMo and/or NiW catalysts on silica-alumina, or on silica-alumina-titanium oxide.

A further particularly advantageous type of catalyst (in particular with improved activity) for hydrorefining comprises a partially amorphous Y zeolite; this catalyst will be described below in relation to the second reaction zone of the process.

In general, the hydrorefining catalyst contains:

5% to 40% by weight of at least one element from groups VIB and non noble group VIII (% oxide);

0-20% of at least one promoter element selected from phosphorus, boron, silicon (% oxide), preferably 0.1-20%; advantageously, boron and/or silicon are present, and optionally phosphorus;

0-20% of at least one group VIIB element (for example manganese);

0-20% of at least one group VIIA element (for example fluorine or chlorine);

0-60% of at least one group VB element (for example niobium);

0.1-95% of at least one matrix, preferably alumina.

The catalysts described above are generally used to carry out hydrorefining, also known as hydrotreatment.

Prior to injecting the feed, the catalysts used in the process of the invention preferably undergo a sulphurisation treatment to transform at least a portion of the metallic species into the sulphide before bringing them into contact with the feed to be treated. This sulphurisation activation treatment is well known to the skilled person and can be carried out using any method that has already been described in the literature, either in-situ, ie, in the reactor, or ex-situ.

One well-known conventional sulphurisation method consists of heating in the presence of hydrogen sulphide (pure or, for example, in a stream of a hydrogen/hydrogen sulphide mixture) at a temperature in the range 150° C. to 800° C., preferably in the range 250° C. to 600° C., generally i n a traversed bed reaction zone.

In the first reaction zone of the process, the feed is brought into contact in the presence of hydrogen with at least one catalyst as described above, at a temperature in the range 330° C. to 450° C., preferably 360-420° C., at a pressure in the range 5 to 25 MPa, preferably less than 20 MPa, the space velocity being in the range 0.1 to 6 $h^{-1}$, preferably 0.2-3 $h^{-1}$, and the quantity of hydrogen introduced is such that the litres of hydrogen/litres of hydrocarbon volume ratio is in the range 100 to 2000 l/l.

In the first reaction zone of the process of the invention, a substantial reduction in the amount of organic nitrogen-containing and sulphur-containing compounds and the amount of condensed polycyclic aromatic hydrocarbons is obtained. Under these conditions, at least a portion of the organic nitrogen-containing and sulphur-containing products are also transformed into $H_2S$ and $NH_3$, at least part of which will be eliminated by the intermediate hot flash. This operation, then, can eliminate two types of compounds which are known to inhibit the zeolitic catalyst.

In one implementation of the invention, when the second reaction zone contains no hydrorefining catalyst bed, the amount of organic nitrogen in the effluent at the outlet from the first reactor is less than 20 ppm by weight, preferably less than 10 ppm by weight. In a preferred implementation of the invention, when the second reaction zone comprises at least one hydrorefining catalyst in the hydrocracking reactor or in a separate reactor, the amount of ammonia in the feed admitted onto the catalyst is in the range 300 to 1500 ppm by weight of nitrogen, preferably in the range 400 to 1200 ppm, more preferably in the range 400 to 800 ppm. The operating conditions under which this complementary hydrorefining is carried out are such that the amount of organic nitrogen in the feed from said hydrorefining stage and which is then admitted into the hydrocracking catalyst bed, is less than 20 ppm by weight, preferably less than 10 ppm by weight.

In the first reaction zone of the process, pre-cracking of the feed to be treated is also carried out. Advantageously, this adjustment can be carried out by adjusting the nature and quality of the catalyst or catalysts used in the first reaction zone and/or the operating conditions of this first reaction zone. In the process of the invention, the conversion in the first reaction zone into products with boiling points of less than 340° C., preferably less than 370° C., is more than 5%, preferably more than 10%.

Intermediate Hot Flash

The effluent from this first reaction zone is sent to a separation means (for example a separator drum) with the aim of separating ammonia ($NH_3$) and hydrogen sulphide ($H_2S$) produced in the first reaction zone. The operating pressure is not substantially reduced during the flash.

Said flash is carried out at a pressure close to the operating pressure of the first reaction zone, minus the pressure drop caused by any passage of effluent through the heat exchangers. The pressure of said flash is thus generally in the range 40 to 250 bars. The temperature is adjusted to between 50° C. and 400° C., preferably between 150° C. and 300° C., depending on the desired effect. More preferably, the temperature of the intermediate hot flash is less than 250° C. Under these conditions, more than 70% (preferably more than 90%) of the ammonia produced in the first reaction zone is eliminated. At the same time, substantially the same proportion of $H_2S$ present in the effluent from the first reaction zone is eliminated. During this flash, almost all of the non-cracked portions of the feed from the first reaction zone are recovered in the liquid fraction (normally more than 90%, generally more than 99%). Regarding the gas, gasoline, kerosene, diesel fractions produced in the first reaction zone, they are divided between the liquid phase and the vapour phase.

The hydrocarbon-containing effluent from said flash thus does not undergo distillation and at least part, preferably all of it is introduced into the second reaction zone of the process of the invention.

Second Reaction Zone

The hydrocarbon-containing effluent from the intermediate flash (or any other means for separating ammonia) is sent to at least one second reaction zone. This hydrocarbon-containing effluent generally contains 300 to 1500 ppm by weight of nitrogen, preferably between 400 and 1200 ppm, more preferably between 400 and 800 ppm by weight of nitrogen.

The quantity of residual hydrogen sulphide ($H_2S$) present in the hydrocarbon effluent introduced into the second reaction zone after the intermediate flash is generally in the range 100 ppm to 10000 ppm, preferably in the range 500 ppm to 3000 ppm to maintain the hydrocracking catalyst within its ideal functioning range; however, other values may be suitable.

The quantities of residual $NH_3$ and $H_2S$ can optionally be adjusted by the operator during the course of the reaction.

The operating conditions used in the reactor or reactors located downstream of the intermediate flash of the process of the invention are: a temperature of more than 200° C., usually in the range 250-480° C., advantageously in the range 320° C. to 450° C., preferably in the range 330° C. to 425° C.; at a pressure that is usually in the range 5 to 25 MPa, preferably less than 20 MPa; the space velocity is in the range 0.1 to 20 $h^{-1}$, preferably 0.1-6 $h^{-1}$, more preferably 0.2-3 $h^{-1}$; and the quantity of hydrogen introduced is such that the volume ratio of the litres of hydrogen/litres of hydrocarbon is in the range 80 to 5000 l/l, usually in the range 100 to 2000 l/l.

These operating conditions used in the second reaction zone of the process of the invention can achieve conversions per pass into products with boiling points of less than 340° C., preferably less than 370° C., of more than 30% by weight, preferably in the range 40% to 95% by weight.

The second reaction zone located downstream of the intermediate flash comprises at least one reactor containing at least one bed of hydrocracking catalyst. The hydrocracking catalysts used in the hydrocracking processes are all bifunctional, associating an acid function with a hydrogenating function. The acid function is supplied by supports with large surface areas (150 to 800 $m^2/g$ in general) with a superficial acidity, such as halogenated aluminas (in particular chlorinated or fluorinated), combinations of boron and aluminium oxides, amorphous silica-aluminas and zeolites. The hydrogenating function is supplied either by one or more metals from group VIII of the periodic table, or by an association of at least one metal from group VIB of the periodic table and at least one metal from group VIII.

Said catalyst comprises at least one crystalline acid function such as a Y zeolite, or an amorphous acid function such as a silica-alumina, at least one matrix and a hydrodehydrogenating function. It can also optionally contain at least one element selected from boron, phosphorus and silicon, at least one element from group VIIA (chlorine or fluorine, for example), at least one element from group VIIB (for example manganese), and at least one element from group VB (for example niobium).

Preferably, the second reaction zone also comprises at least one bed of hydrorefining catalyst that may be identical to or different from that used in the first reaction zone upstream of the intermediate flash and placed in the hydrocracking reactor of the second reaction zone upstream of the hydrocracking catalyst comprising at least one Y zeolite or at least one amorphous acidic function, such as an amorphous silica-alumina.

In a further preferred implementation of the invention, the hydrorefining catalyst and the catalyst comprising at least one Y zeolite or a silica-alumina are placed in distinct reactors situated downstream of the intermediate flash. In all cases, the reactor or reactors containing the hydrorefining catalyst is/are upstream of the reactor or reactor(s) containing the catalyst based on Y zeolite or silica-alumina.

Said hydrorefining catalyst was described above in the paragraph dealing with the first reaction zone of the process of the invention.

In these preferred cases, a hydrocarbon-containing effluent that may still contain organic nitrogen in a quantity of less than 1500 ppm, generally between 300-1500 ppm of organic nitrogen, preferably 400-1200 ppm and still more preferably 400-800 ppm can be admitted into the second zone. Ammonia separation is then adjusted so that the sum of the quantity of residual ammonia ($NH_3$) present in the hydrocarbon effluent after flash and the quantity of ammonia generated by the organic nitrogen in the hydrorefining stage of the second zone is within the limits of the invention, i.e., more than 100 ppm by weight of nitrogen and less than 1500 ppm by weight of nitrogen. The preferred ranges are those described above; the same is true for the quantity of organic nitrogen present on the zeolite.

Zeolitic Catalyst

The amount of organic nitrogen in the effluent arriving at the catalyst bed comprising at least one Y zeolite must advantageously be less than 50 ppm by weight, preferably less than 30 ppm by weight, more preferably less than 20 ppm by weight and still more preferably less than 10 ppm by weight.

The catalyst comprising at least one Y zeolite also comprises at least one porous or low crystallinity oxide type mineral matrix. Non limiting examples are aluminas, silicas, silica-aluminas, aluminates, alumina-boron oxide, magnesia, silica-magnesia, zirconia, titanium oxide and clay, used alone or as a mixture.

The hydrodehydrogenating function is generally ensured by at least one element from group VIB (for example molybdenum and/or tungsten) and/or at least one non noble element from group VIII (for example cobalt and/or nickel) of the periodic table. A preferred catalyst essentially contains at least one group VI metal and/or at least one non noble group VIII metal, Y zeolite and alumina.

A still more preferable catalyst essentially contains nickel, molybdenum, a Y zeolite and alumina.

Preferably, the catalyst comprises at least one element selected from the group formed by boron, silicon and phosphorus. Advantageously, the catalyst optionally comprises at least one element from group VIIA, preferably chlorine or fluorine, optionally at least one element from group VIIB (for example manganese) and optionally at least one element from group VB (for example niobium).

The boron, silicon and/or phosphorus can be in the matrix, the zeolite or, as is preferable, deposited on the catalyst and principally localized on the matrix. A preferred catalyst contains B and/or Si as a promoter element, preferably deposited along with a phosphorus promoter. The quantities introduced are 0.1-20% by weight of catalyst, calculated as the oxide.

The element introduced, and in particular silicon, principally located on the matrix of the support, can be characterized by techniques such as the Castaing microprobe (distribution profile of the various elements), transmission electron microscopy coupled with X ray analysis of the components of the catalysts, or by drawing up a distribution map of the elements present in the catalyst by electronic microprobe.

In general, the hydrocracking catalyst for the second reaction zone advantageously comprises:

- 0.1-80% by weight of Y zeolite;
- 0.1-40% by weight of at least one element from groups VIB and VIII (% oxide);
- 0.1-99.8% by weight of matrix (% oxide);
- 0-20% by weight of at least one element selected from the group formed by P, B, Si (% oxide), preferably 0.1-20%;
- 0-20% by weight of at least one element from group VIIA, preferably 0.1-20%;
- 0-20% by weight of at least one element from group VIIB, preferably 0.1-20%;
- 0-60% by weight of at least one element from group VB, preferably 0.1-60%.

Regarding the silicon, the range 0-20% encompasses only the silicon that is added and not that in the zeolite.

The zeolite can optionally be doped by metallic elements such as metals from the rare earths, in particular lanthanum or cerium, or noble or non noble metals from group VIII such as platinum, palladium, ruthenium, rhodium, iridium, iron and other metals such as manganese, zinc or magnesium.

Different Y zeolites can be used.

A particularly advantageous H—Y acidic zeolite is characterized by different specifications: an overall $SiO_2/Al_2O_3$ mole ratio in the range about 6 to 70, preferably in the range 12 to 50: a sodium content of less than 0.15% by weight determined for zeolite calcined at 1100° C.; a lattice parameter of the unit cell in the range $24.58\times10^{-10}$ m to $24.24\times10^{-10}$ m, preferably in the range $24.38\times10^{-10}$ m to $24.26\times10^{-10}$ m; a sodium ion takeup capacity CNa, expressed in grams of Na per 100 grams of modified zeolite, neutralized then calcined, of more than about 0.85; a specific surface area, determined using the BET method, of more than about 400 $m^2/g$, preferably more than 550 $m^2/g$; a water vapour adsorption capacity at 25° C. at a partial pressure of 2.6 torrs (i.e., 34.6 MPa) of more than about 6%; and advantageously, the zeolite has a pore distribution, determined by nitrogen physisorption, in the range 5% to 45% and preferably in the range 5% to 40% of the total pore volume in the zeolite contained in pores with a diameter in the range $20\times10^{-10}$ m to $80\times10^{-10}$ m, and in the range 5% to 45%, preferably in the range 5% to 40% of the total pore volume of the zeolite contained in pores with a diameter of more than $80\times10^{-10}$ m and generally less than $1000\times10^{-10}$ m, the remainder of the pore volume being contained in pores with a diameter of less than $20\times10^{-10}$ m.

A preferred catalyst using this type of zeolite comprises a matrix, at least one dealuminated Y zeolite with a lattice parameter in the range 2.424 nm to 2.455 nm, preferably in the range 2.426 nm to 2.438 nm, an overall $SiO_2/Al_2O_3$ mole ratio of more than 8, an alkaline-earth metal or alkali metal cation and/or rare earth cation content such that the atomic ratio $(n\times M^{n+})/Al$ of less than 0.8, preferably less than 0.5 or 0.1, a specific surface area, determined using the BET method, of more than 400 $m^2/g$, preferably more than 550 $m^2/g$, and a water adsorption capacity at 25° C. for a $P/P_0$ of 0.2 of more than 6% by weight, said catalyst also comprising at least one hydrodehydrogenating metal and silicon deposited on the catalyst.

In an advantageous implementation of the invention, the hydrocracking catalyst comprises at least one matrix, at least one element selected from the group formed by elements from group VIII and group VIB and a partially amorphous Y zeolite.

The term "partially amorphous Y zeolite" means a solid with the following:

- i/ a peak ratio that is less than 0.40, preferably less than about 0.30;
- ii/ a crystalline fraction, expressed with respect to a reference Y zeolite in the sodium (Na) form, which is less than about 60%, preferably less than about 50%, and determined by X ray diffraction.

Preferably, the solid partially amorphous Y zeolites forming part of the composition of the catalyst of the invention enjoy at least one (preferably all) of the following further characteristics:

- iii/ an overall Si/Al ratio of more than 15, preferably more than 20 and less than 150;
- iv/ a $Si/Al^{IV}$ framework ratio that is higher than the overall Si/Al ratio;
- v/ a pore volume of at least 0.20 ml/g of solid, a fraction of which, in the range 8% to 50%, is constituted by pores with a diameter of at least 5 nm (nanometers), namely 50 Å;
- vi/ a specific surface area of 210-800 $m^2/g$, preferably 250-750 $m^2/g$, advantageously 300-600 $m^2/g$.

The peak ratios and crystalline fractions are determined by X ray diffraction and compared with a reference zeolite using a procedure derived from ASTM D3906-97 "Determination of Relative X-ray Diffraction Intensities of Faujasite-type-containing Materials". Reference should be made to this method for the general conditions for applying the procedure and in particular for the preparation of the samples and references.

A diffractogram is composed of characteristic peaks for the crystalline fraction of the sample and a base line essentially caused by diffusion of the amorphous fraction or microcrystalline fraction of the sample (a weak diffusion signal is linked to the apparatus, air, sample carrier, etc). The peak ratio of a zeolite is the ratio, in a predefined angular zone (typically 8° to 40° 2θ when using the Kα1 radiation line of copper, 0.154 nm), of the area of the lines in the zeolite (peaks) to the overall area of the diffractogram (peaks+base line). This peak/(peaks+baseline) ratio is proportional to the quantity of crystalline zeolite in the material. To estimate the crystalline fraction of a sample of Y zeolite, the peak ratio of the sample is compared with that of a reference that is considered to be 100% crystalline (for example NaY). The peak ratio in a perfectly crystalline zeolite is of the order of 0.55 to 0.60.

The peak ratio of a conventional USY zeolite is 0.45 to 0.55; its crystalline fraction compared with a perfectly crystalline NaY is 80% to 95%. The peak ratio of a solid as described in the present description is less than 0.4, preferably less than 0.35. Its crystalline fraction is thus less than 70%, preferably less than 60%.

The partially amorphous zeolites are prepared using the techniques generally employed for dealumination, from commercially available Y zeolites, i.e., generally with high crystallinity (at least 80%). More generally, it is possible to start from zeolites with a crystalline fraction of at least 60% or at least 70%.

The Y zeolites generally used in hydrocracking catalysts are produced by modifying commercially available Na—Y zeolites. This modification can result in zeolites termed stabilized zeolites, ultra-stabilised zeolites or dealuminated zeolites. This modification is carried out using at least one dealumination technique, for example hydrothermal treatment or acid attack. Preferably, this modification is carried out by combining three types of operations that are known to the skilled person: hydrothermal treatment, ion exchange and acid attack.

A further particularly advantageous zeolite is a globally non dealuminated zeolite that is highly acidic.

The term "globally non dealuminated" means a Y zeolite (structure type FAU, faujasite) using the nomenclature developed in the "Atlas of zeolite structure types" by W M Meier, D H Olson and Ch Baerlocher, $4^{th}$ revised edition, 1996, Elsevier. The lattice parameter for this zeolite may have been reduced by extracting aluminium atoms from the structure or framework during preparation but the overall $SiO_2/Al_2O_3$ ratio is not changed as the aluminium atoms have not been chemically extracted. Such an overall non dealuminated zeolite has a silicon and aluminium composition, expressed as the overall $SiO_2/Al_2O_3$ ratio, equivalent to the non dealuminated starting Y zeolite. Values for the parameters ($SiO_2/Al_2O_3$ ratio and lattice parameters) are given below. This overall non dealuminated Y zeolite can either be in the hydrogen form or at least partially exchanged with metallic cations, for example using alkaline-earth metal cations and/or cations of rare earth metals with atomic numbers 57 to 71 inclusive. Preferably, a zeolite that is free of rare earths and alkaline-earths is used, and similarly for the catalyst.

The overall non dealuminated Y zeolite generally has a lattice parameter of more than 2.438 nm, a global $SiO_2/Al_2O_3$ ratio of less than 8, and a framework $SiO_2/Al_2O_3$ mole ratio of less than 21 and more than the overall $SiO_2/Al_2O_3$ ratio. An advantageous catalyst combines this zeolite with a matrix doped with phosphorus.

The overall non dealuminated zeolite can be obtained by dint of any treatment that does not extract aluminium from the sample, such as steam treatment or treatment with $SiCl_4$.

A further advantageous type of catalyst for hydrocracking contains an amorphous acidic oxide matrix of the alumina type doped with phosphorus, an overall non dealuminated and highly acidic Y zeolite and optionally at least one group VIIA element, in particular fluorine.

The invention is not limited to the cited and preferred Y zeolites, but other types of Y zeolites can be used in this process.

Amorphous Catalyst

The non zeolitic hydrocracking catalyst can contain an amorphous acidic function, generally a silica-alumina. It also contains a hydrodehydrogenating function and optionally, a matrix. It can optionally also contain at least one promoter element (boron, phosphorus and/or silicon), at least one group VIIA element (chlorine, fluorine), at least one group VIIB element (for example manganese), and at least one group VB element (for example niobium). The above description pertaining to these elements is also applicable in this instance.

The role of the hydrodehydrogenating function for the hydrocracking catalyst comprising at least one amorphous acidic function is preferably fulfilled by at least one metal or compound of a non noble group VIII metal and VI metal preferably selected from molybdenum, tungsten, nickel and cobalt. Preferably, this role is fulfilled by a combination of at least one group VIII element (Ni, Co) with at least one group VIB element (Mo, W).

Advantageous catalysts for hydrocracking are NiMo catalysts and/or NiW catalysts on silica-alumina, or on silica-alumina-titanium oxide.

Prior to injecting the hydrocarbon effluent into the second reaction zone of the process of the present invention, the catalyst undergoes a sulphurisation treatment to transform at least a portion of the metallic species into the sulphide before bringing them into contact with the feed to be treated. This sulphurisation activation treatment is well known to the skilled person and can be carried out using any method that has already been described in the literature, either in-situ, ie., in the reactor, or ex-situ.

One well-known conventional sulphurisation method consists of heating in the presence of hydrogen sulphide (pure or, for example, in a stream of a hydrogen/hydrogen sulphide mixture) to a temperature in the range 150° C. to 800° C., preferably in the range 250° C. to 600° C., generally in a traversed bed reaction zone.

Final Separation

The effluent leaving the second reaction zone of the hydrocracking process of the invention undergoes a final separation (for example atmospheric distillation optionally followed by vacuum distillation) to separate the gases (such as ammonia ($NH_3$) and hydrogen sulphide ($H_2S$) and the other light gases present, hydrogen and possibly conversion products . . . ). At least one residual liquid fraction essentially containing products with a boiling point that is generally more than 340° C. is obtained, at least part of which can be recycled upstream of the second reaction zone of the process of the invention, and preferably upstream of the hydrocracking catalyst based on a Y zeolite or silica-alumina.

Facility

The invention also concerns a facility for carrying out a hydrocracking process in accordance with the invention, the facility comprising:

- a first reaction zone comprising at least one hydrorefining reactor (2) containing at least one catalyst bed to carry out hydrorefining of the feed;
- at least one line (1) to introduce the feed into the first reactor of the first hydrorefining reaction zone, at least one line (3) to supply hydrogen to said reactor and at least one line (4) to carry effluent from the last reactor of the first zone of the process;

at least one separation means (5) to separate ammonia via a line (6) from the effluent leaving the first reaction zone;

at least one hydrocracking reactor (8) in at least one second reaction zone downstream of said separation means, comprising at least one catalyst bed to carry out hydrocracking of at least a portion of the effluent (7) from said means (5);

at least one line (9) for introducing hydrogen into at least the first hydrocracking reactor in the second reaction zone, at least one line (10) for carrying effluent from the last reactor of the second reaction zone;

at least one distillation column (13) to separate converted products (14), (15), (16), a residue (17) and a gaseous effluent (20) from at least a portion of said effluent;

optionally, at least one separation means (11) to separate the gases from the effluent leaving the last reactor in the second reaction zone, and at least one column for separating at least a portion of said effluent, the converted products and a residue;

optionally, a line (19) to recycle at least a portion of the residue to the hydrocracking reactor (8) of said second reaction zone;

the facility also optionally comprising other equipment such as pumps, compressor, stills and heat exchangers, which are not shown in the diagram.

DESCRIPTION OF THE FIGURES

The invention is illustrated in FIGS. 1*a* and 1*b*.

In FIG. 1*a*, the feed to be treated enters via a line (1) into at least one hydrorefining reactor (2) in the first reaction zone containing at least one bed of hydrorefining catalyst. It is mixed with hydrogen supplied via a line (3).

Figure 1A:
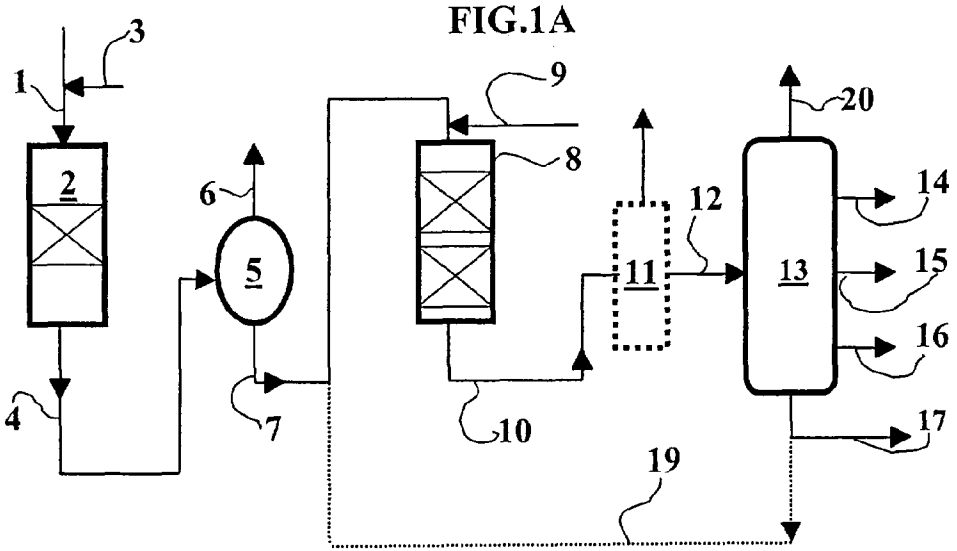
FIG. 1*a* represents a simplified diagram of the process and the facility.

The effluent leaving the first reaction zone via a line (4) is sent to a separation means (5), for example a flash separator. The gases are recovered via a line (6) and the resulting liquid effluent is recovered via a line (7).

In the once-through process, at least a portion of the liquid effluent is then sent to the second reaction zone into a reactor (8) containing at least one bed of hydrocracking catalyst (22) and at least one bed of hydrorefining catalyst (21) located upstream of the hydrocracking catalyst (22). Hydrogen is added to this liquid effluent via a line (9). Effluent leaving the second zone of the process via a line (10) can optionally be separated from gas in a gas-liquid separator (11) (shown in the figure as dotted lines). The resulting liquid leaving via a line (12) is generally introduced into at least one column to separate converted products from at least a portion of said effluent (in FIG. 1*a:* all of the effluent): liquid effluents (14), (15), (16) and gaseous effluent (20), along with a residue (17).

A portion of the residue can optionally be recycled via a line (19) to the hydrocracking reactor (8) of the second reaction zone.

FIG. 1*a* shows a hydrorefining reactor (2) and a hydrocracking reactor (8). Reactors in series can be provided for both hydrorefining and hydrocracking.

Figure 1B:
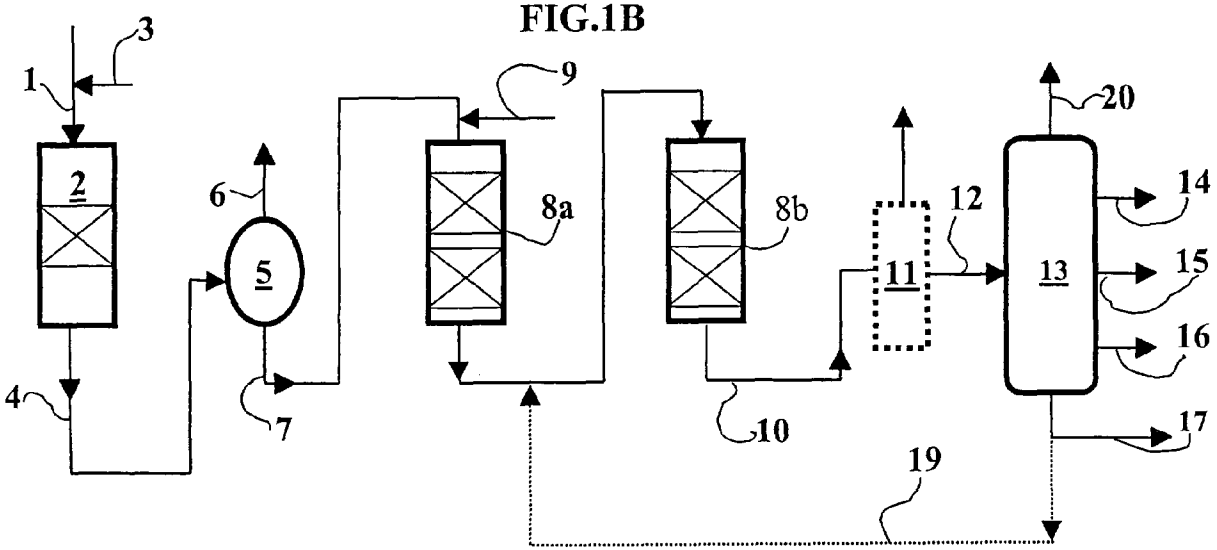
FIG. 1*b* shows a preferred implementation.

In a preferred method shown in FIG. 1*b*, we can recognise the elements shown in FIG. 1*a*. the hydrorefining catalysts (21) and hydrocracking catalysts (22) of the second reaction zone of the process of the invention are located in distinct reactors (8*a*) and (8*b*). The second reaction zone of the process associates one or more hydrorefining reactors comprising one or more beds of hydrorefining catalyst upstream of one of more hydrocracking reactors comprising one or more beds of hydrocracking catalyst. Recycling the residue (17) from the separation column (13) is optionally carried out via a line (19) to a point located downstream of the last hydrorefining reactor.

In these preferred implementations, we have shown in a non limiting manner in the second reaction zone the presence of a hydrorefining catalyst upstream of the hydrocracking catalyst. The presence of this hydrorefining catalyst is optional.

The preceding examples can be repeated with similar success by substituting the generically or specifically described reactants and/or operating conditions of this invention for those used in the preceding examples.

The entire disclosure of all applications, patents and publications, cited above and below, and of corresponding French Application No. 01/13.300, filed Oct. 15, 2001 is hereby incorporated by reference.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A once-through continuous process for hydrocracking a hydrocarbon-containing feed having a high organic nitrogen content for the production of middle distillates, comprising:

reacting the hydrocarbon-containing feed having a high organic nitrogen content in a first catalytic hydrorefining reaction with a hydrorefining catalyst, such that at least a portion of the organic nitrogen content is transformed to ammonia, subjecting the effluent from the first hydrorefining reaction to a hot flash resulting in incomplete separation of ammonia therein, downstream from the hot flash, reacting the resulting hot flashed hydrocarbon-containing feed in a second catalytic hydrorefining reaction with a hydrorefining catalyst, such that the combination of the hot flash and the second catalytic hydrorefining reaction results in reducing the ammonia content to provide and maintain a quantity of ammonia, in terms of nitrogen by weight, of more than 400 ppm and less than 1200 ppm in the second catalytic hydrorefining reaction effluent, which nitrogen content is obtained solely from the second catalytic hydrorefining reaction effluent, and further such that the amount of organic nitrogen in the second catalytic hydrorefining reaction effluent is less than 20 ppm by weight, hydrocracking at least a portion of the effluent from the second catalytic hydrorefining reaction in a catalytic hydrocracking zone with a hydrocracking catalyst comprising either a zeolitic catalyst or a non-zeolitic catalyst.

2. A process according to claim 1, in which the quantity of ammonia is reduced such that the quantity of nitrogen present during the hydrocracking is more than 400 ppm and less than 1000 ppm by weight of nitrogen.

3. A process according to claim 1, in which the quantity of ammonia is reduced such that the quantity of nitrogen present during the hydrocracking is more than 400 ppm and less than 800 ppm by weight of nitrogen.

4. A process according to claim 1, in which the quantity of nitrogen present during the hydrocracking is more than 500 ppm and less than 1200 ppm.

5. A process according to claim 1, in which the incomplete separation of ammonia by the hot flash eliminates more than 70% of the ammonia produced in the first hydrorefining reaction.

6. A process according to claim 1, wherein the second catalytic hydrorefining reaction is conducted in a reaction zone containing at least one bed of hydrorefining catalyst that is different from the hydrorefining catalyst used in the first catalytic hydrorefining reaction.

7. A process according to claim 1, wherein the hydrocracking catalyst is non-zeolitic and comprises an amorphous acidic function, a hydrodehydrogenating function and optionally a matrix.

8. A process according to claim 1, wherein the hydrocracking catalyst is a zeolitic catalyst comprising at least one Y zeolite, at least one matrix and a hydrodehydrogenating function ensured by at least one element from group VIB and/or at least one non noble element from group VIII.

9. A process according to claim 1, in which the hydrocracking and/or hydrorefining catalyst also comprises at least one promoter element deposited on the surface of the catalyst and selected from the group formed by phosphorus, boron and silicon.

10. A process according to claim 9, in which the hydrocracking and/or hydrorefining catalyst comprises boron and/or silicon and optionally phosphorus as the promoter element.

11. A process according to claim 7, in which the hydrocracking catalyst further comprises at least one element selected from the group formed by elements from group VIIA.

12. A process according to claim 8, in which the hydrocracking catalyst further comprises at least one element selected from the group formed by elements from groups VIIA, VIIB and VB.

13. A process according to claim 1, in which the hydrocracking catalyst is a zeolitic catalyst and the amount of organic nitrogen in the second catalytic hydrorefining reaction effluent is less than 10 ppm by weight.

14. A process according to claim 1, wherein the hot flash is conducted at between 50° and 300° C. under a pressure of 40 to 250 bars, said pressure being close to the operating pressure of the first reaction zone minus the pressure drop caused by passage through any heat exchangers.

15. A process according to claim 1, wherein the second catalytic hydrorefining reaction is conducted in a reaction zone located separate from a reaction zone in which the hydrocracking is conducted.

16. The process of claim 1, wherein the hydrocarbon-containing feed having a high organic nitrogen content of more than 500 ppm.

17. The process of claim 1, wherein the hydrocarbon-containing feed having a high organic nitrogen content of 500 ppm to 5000 ppm.

* * * * *